US008851198B2

(12) United States Patent
Burnham

(10) Patent No.: US 8,851,198 B2
(45) Date of Patent: Oct. 7, 2014

(54) TRACTABLE, FIRE-RESISTANT, THERMO-INSULATED COVERS AND ENCLOSURES

(76) Inventor: Herbert R. Burnham, Chula Vista, CA (US)

( * ) Notice: Subject to any disclaimer, the term of this patent is extended or adjusted under 35 U.S.C. 154(b) by 788 days.

(21) Appl. No.: 12/932,761

(22) Filed: Mar. 7, 2011

(65) Prior Publication Data

US 2012/0227990 A1 Sep. 13, 2012

(51) Int. Cl.

| | |
|---|---|
| ***A62C 8/06*** | (2006.01) |
| ***A62C 2/06*** | (2006.01) |
| ***E04D 5/00*** | (2006.01) |
| ***E04D 5/14*** | (2006.01) |
| ***E04H 15/18*** | (2006.01) |
| ***E04H 15/00*** | (2006.01) |
| ***A62C 3/02*** | (2006.01) |

(52) U.S. Cl.

CPC ..... *A62C 2/06* (2013.01); *A62C 3/0257* (2013.01); *A62C 3/0214* (2013.01)

USPC ..... 169/48; 52/3; 52/5; 52/79.1

(58) Field of Classification Search

USPC ..... 169/48–50; 428/99, 102, 920, 921; 52/3, 5, 79.1, DIG. 12

See application file for complete search history.

(56) References Cited

U.S. PATENT DOCUMENTS

| | | | | |
|---|---|---|---|---|
| 2,183,113 | A * | 12/1939 | Bennett | 169/50 |
| 2,720,269 | A * | 10/1955 | Diacos | 169/50 |
| 3,715,843 | A * | 2/1973 | Ballinger | 52/3 |
| 3,766,958 | A * | 10/1973 | Mitchell | 160/84.02 |
| 4,597,450 | A * | 7/1986 | Budmiger | 169/50 |
| 5,608,992 | A * | 3/1997 | Floyd | 52/3 |
| 5,860,251 | A * | 1/1999 | Gleich | 52/2.25 |
| 5,966,877 | A * | 10/1999 | Hawes | 52/63 |
| 6,102,128 | A * | 8/2000 | Bridgeman | 169/49 |
| 6,521,362 | B2 * | 2/2003 | Koeppen | 169/46 |
| 6,742,305 | B2 * | 6/2004 | Rogers et al. | 52/3 |
| 6,881,506 | B2 * | 4/2005 | Anderson et al. | 442/228 |
| 7,395,869 | B2 * | 7/2008 | Schnabel et al. | 169/48 |
| 2003/0198777 | A1 * | 10/2003 | McIntee et al. | 428/102 |
| 2004/0035059 | A1 * | 2/2004 | Meyer et al. | 52/1 |
| 2004/0158924 | A1 * | 8/2004 | Frandsen-Anderson et al. | 5/483 |
| 2004/0262018 | A1 * | 12/2004 | Roussin | 169/50 |
| 2008/0000648 | A1 * | 1/2008 | Kleff | 169/48 |
| 2008/0217028 | A1 * | 9/2008 | Crumpton | 169/48 |
| 2009/0194297 | A1 * | 8/2009 | Ortiz Teruel | 169/50 |
| 2009/0209155 | A1 * | 8/2009 | Goulet | 442/234 |
| 2009/0242217 | A1 * | 10/2009 | van de Loenhorst | 169/46 |
| 2009/0260838 | A1 * | 10/2009 | Jungermann | 169/54 |
| 2010/0086763 | A1 * | 4/2010 | Huang | 428/221 |
| 2010/0200251 | A1 * | 8/2010 | Garcia et al. | 169/49 |
| 2010/0269449 | A1 * | 10/2010 | Bush et al. | 52/741.3 |
| 2010/0294520 | A1 * | 11/2010 | Aguirre | 169/45 |
| 2011/0088919 | A1 * | 4/2011 | Kim et al. | 169/65 |

* cited by examiner

*Primary Examiner* — Darren W Gorman

(57) ABSTRACT

Protective covers made with fire-resistant and thermo-insulated blankets to shield diverse structures and objects from fire. Interconnective tent units forming protective surface passageways for sheltering and evacuating firemen at fire locations and for providing tactical shelter for security personnel. Novel tent configurations having optimal packaging and surface coverage characteristics. Ground-covering blankets for stopping ground-level fire and for diverse fire-fighting tactical applications.

5 Claims, 8 Drawing Sheets

TRACTABLE, FIRE-RESISTANT, THERMO-INSULATED COVERS AND ENCLOSURES

BRIEF DESCRIPTION OF THE INVENTION

Tractable and flexible covers and semi-rigid covers and enclosures used as protection from external sources of fire such as wildfires. Diverse fire-resistant and heat insulated flexible blankets adapted to wrap and enclose a structure such as a house, to protect it from direct fire, from reflected heat and from flying embers and sparks. Fire-resistant tents used individually or connected end-to-end forming a single, long, protective enclosure or tunnel which serves as a refuge and fire escape for firemen surrounded by fire. Protective tents adapted to resist bullet and explosive fragmentation impact. Novel bellows design for tents to reduce bulk and lengthen cover. Portable fire breaks in the shape of fire resistant ground covers to stop ground level fire spread and other uses.

BACKGROUND OF THE INVENTION

Fire is a state of combustion manifested in light, flame and heat; it is usually associated with smoke, as a byproduct. Fire starts when there is a combination of three factors: heat+fuel+oxygen; it may be triggered by a spark, lightning or by another intense concentration of heat. Fire vaporizes the surface of solid fuels such as wood, allowing the vapor to mix with oxygen to thereby prolong fire in a sustained chain reaction. Wood flashpoint is 572 deg C., but an advancing wildfire can reach temperatures of 800 deg C., heating up its environs and radiating heat which starts drying and preheating in advance the waiting fuel which will then ignite readily.

Wildfires burn an average of 5 million acres of prairie and woodlands every year in the U.S. alone. Some fires start naturally and some are the result of arson or of carelessness by hikers or campers. Once a wildfire starts, it can advance at a velocity of about 6.8 mph in forests and up to 14 mph in grasslands. Additionally, the wind can carry embers far ahead of the fire line and start new fires elsewhere. The rate of spread depends on the availability of dry grass or wood, topography, wind speed, ambient temperature and humidity. Direction of spread of fire can be influenced not only by the distribution of fuel but by the wind. Accordingly, some fires change direction abruptly, trapping firefighters in their midst.

An area which has remained without burning for some years will have accumulated a great amount of fuel and will likely have fires of greater intensity. If the fuel load in a forest is high, the fire can burn with great intensity and reach the canopy of the forest and burn the trees in their entirety. It can also result in a crown fire which will burn the tops of the trees and other aerial fuels and spread at a different rate from the surface fire. A smaller surface fuel load with no significant presence of ladder fuels may result in a fire that only clears up the brush and leaves the canopy intact, allowing trees to survive and seeds to eventually sprout and regenerate vegetation on the forest floor.

Firefighters locate wildfires, evaluate intensity, direction of spread, velocity and danger posed to settled areas. At a fire station or at an observation post, the fire is designated a Box number with which all necessary equipment is immediately identified and presumably gathered for the fire fight. Traditional equipment such as shovels, pulaskis, rakes and brush hooks and brush blades is still being used by crews. Small fire engines, called brush trucks when outfitted for wildfires, are also used when roads and trails are available. Aircraft perform many tasks such as observation, evacuation of personnel and civilians, dropping of supplies by parachute and dropping of retardant on the fire by air tankers. Firefighters on the ground perform dangerous tasks, the more so since the fire conditions may change without warning: the burning front may change direction, closing escape routes; and flare-ups and blowups often change the status of the fire front from manageable to unmanageable. Firefighter deaths are frequent in these operations; in 2008 alone, 118 firefighters lost their lives while on duty (FEMA Quickstats). Firefighters use protective clothing called 'turnout gear' during operations. These garments may be made of Nomex and sometimes reinforced in a combination of Nomex and Kevlar, where the combination of these fibers provides thermal and abrasive resistant properties to the garments. Said turnout gear is highly advanced and very useful, nonetheless, it is not always sufficient protection near a fire front reaching 800 deg C. Fire resistant gear will not burn but cannot provide enough insulation from high temperatures.

Both fire resistance and heat insulation are needed simultaneously, however, it is impractical to cover a fireman with way-too-bulky heat insulation while he or she is working strenuously just to guard against a possible flareup or encirclement by fire. Real protection can only be provided inside an enclosure where flames, radiant heat and smoke cannot enter. Firemen need protective enclosures which will resist radiant heat and actual flames. These enclosures should contain water and oxygen tanks to be used when surrounding fire sucks up all available oxygen. A small cover of last resort as currently used, without an oxygen bottle is insufficient to keep a firefighter from burning to death and/or from quickly suffocating. Clearly, firefighters need new types of equipment to remain safe while on duty and need as well novel equipment to fight fires with more efficiency and safety.

The practice of putting out fires in the wildlands has eliminated, in some places, the natural cycles of fire and re-growth of vegetation. As a consequence, the accumulation of dry wood, leaves and grass is a fuel load which continues to grow until a next fire opportunity arrives, at which time it will be harder to control and to extinguish. Entire forests are burning because the fuel load is high when it could be low and less dangerous had natural cycles not been interrupted.

In the present situation, the response cannot be to let all wildfires burn unchecked in order to restore natural cycles because of many reasons, including the following considerations:

The first one is that the spread of human settlement has already pushed well into many grasslands and wilderness areas. Thousands of new homes, businesses, schools and related expensive infrastructure are already located in the wildland/urban interface. It is their constant reality the possibility of being reached by a wildfire and possibly be destroyed by it. What is needed is new ways to fight fire and new products to protect structures against fire.

The second consideration is that a destabilized area will have to undergo careful restoration steps in order to recover. The physical removal of the fuel load by cleaning crews is part of the solution. Prescribed burning will continue to be necessary but, as currently practiced is not altogether fail-safe and sometimes gets out of control and becomes a big fire. Firefighters conducting a prescribed burn can be exposed to dangerous concentrations of carbon monoxide during short periods of time "presumably because firefighters feel compelled to keep the fire within prescribed boundaries at all costs" (see Recommendation #6—Colorado Firecamp Dec. 21, 2009 coloradofirecamp.com). New firefighting products must be incorporated and new tactics developed in order to protect firefighters and to fine-tune prescribed burns.

The third consideration is that the climate appears to be changing fast around the world. Whether the trend will continue, stop or reverse cannot be determined. Many areas have become drier and some have suffered droughts of unexpected intensity and duration. At a time when experts realize human interference has made the problem worse is when remedial activity by humans is needed with greater urgency. A better understanding of the new climatic shifts will allow humanity to look for protective equipment when natural forces cannot be influenced for the better. We must learn to shield our cities and protect our firemen while we learn how to reduce our ecological footprint and how to cope with disaster in new ways.

According to Recommendation #9 (Colorado Firecamp Dec. 21, 2009) "Standard setting bodies should consider developing a national standard that firefighters can utilize during wildfire incidents for identifying and marking wildfire/urban interface properties based on the ability to defend the structures located on that property. The triage to determine whether a structure can be saved or not from approaching wildfire is indispensable because the life and safety of firefighters should not be put on line for structures that cannot be defended and because their participation in worthwhile activities is being wasted along with other valuable resources." In addition to this recommendation, firemen need new types of equipment that will keep them safer, whether a structure can be defended or not. The new equipment must also give way to new tactics in the fight against fire which may give better results than those currently being obtained.

People who live in, or own buildings located inside or near the wildland/urban interface are slowly learning to take measures to protect their properties against fire. Fire departments recommend the removal of all combustible materials within several feet of the building in question. This includes removing trees, shrubs, presumably even wooden fences and all other materials which may burn. Usually this also means last-minute removal of patio furniture, gas tanks, firewood, and flammable liquids used in outdoor cooking. The building itself should be closed tight when the fire is near, and the building itself evacuated by people and pets. Adults as well as children should have knowledge of all possible escape routes and have learned all the safety practices that are needed during emergencies. Defense of the building will next be in the hands of the firemen, if they can reach it on time and depending on diverse circumstances such as the availability of water and the probability of making a safe stand.

Houses and other structures still burn, however, because they are made of wood and of other flammable materials. Even though some sections of the average home may now be made with safe new fireproof materials, there are still many factors that contribute to home fires. It is noted that the majority of the improvements have been designed to protect the house from fire originating inside the house, but fire may come from outside and enter through vents, broken windows and through other inlets. Fires originating inside the house may come from electrical outlets and cables used indifferently for diverse household apparatus. In this instance, overuse or carelessness may be the main factor leading to fire. Fire coming from stationary apparatus such as water heaters, central heaters, chimneys, and stoves may originate as a consequence of carelessness, or because the apparatus is not in good repair. Fire also happens under unforseeable conditions. For example, a chimney fire may be due to the undetected accumulation over time of creosote and other byproducts. Fire spreads along wooden beams, floors and doors. Furniture, drapes, clothing, newspapers, and books catch fire and increase the flame volume, leading to a flashover at which point the house cannot be saved.

In the last few decades, many fire-resistant materials have been introduced for use inside buildings. There is an ample availability of products such as fiberglass cloth to protect hoses and cables, asbestos sheets used on thermal installations, asbestos tape to insulate boilers and pipe lines, aluminum silicon fiber blankets as fire-proof lining, heat insulating foams, aluminum lining to reflect radiant heat, and much more. There are also many chemicals by DuPont, BASF, Teijin and other chemical industries to treat diverse products and make them fire resistant and/or to resist the spread of fire.

Building codes and safety recommendations have also made some progress in making houses more resistant to fire. This includes using ceramic tile instead of wooden roofing, closing of all vents and using non-combustible materials in the façade.

In the wildlands, the use of flame retardants to slow down or even stop the advance of fire is a logical step in the fight against fire. There are different types of retardants, each working in a particular way. When a thermal insulation barrier is introduced, it can reduce the intensity of temperature, making fire less likely to spread. When the fuel is diluted by the addition of an inert filler, there is less material to burn and a proportional diminution of heat per volume will be obtained. Some retardants, however, can be harmful to the environment and cause physical damage to human beings and animals. Alarming levels of toxicity coming from these sources have been detected in ground water, rivers and sea coasts. Toxic byproducts have entered the food chain and have even been detected in breast milk. As a consequence, asbestos, brominated flame retardants, polychlorinated biphenyls and other products have been banned in the United States and some European countries. Ground covers, as proposed herein, stop fire without contamination of the ground.

A gel has been introduced which consists of an absorbent polymer which holds great amounts of water. (see www.phys-org.com/news111168779.html Oct. 7, 2007 by Joe Kafka). It is sticky and can be sprayed on a house as protection against external fire. It is effective as long as it retains water. It has been tested by firefighters (see KTAR.com by AP Oct. 13, 2007) who have found it works well as a fire retardant. It remains to be seen, however, if it remains effective under difficult or varied circumstances. For example, covering a house with gel and waiting a week to 10 days for the wildfire to reach it may stretch its usefulness to a point where it does not work. Also, very dry weather, radiant heat and strong winds may reduce effectiveness if the loss of water is high. If gel covering a vent in the attic dries up, the entrance may be open for embers dispersed by the wind, and this may ignite an indoor fire. Presumably radiant heat may go through a layer of gel, heating up the surface but not igniting it just for the lack of oxygen. A glass window covered with gel may let radiant heat enter the house, and this alone may become a source of fire. Therefore, the combination of adverse factors in time, humidity, radiant heat and wind may yet limit its efficacy.

General Description and Field of the Invention

The Tractable Envelope for Buildings or House Cover. The invention is a comprehensive system of covers and enclosures with which it is possible to obtain protection from external fire for buildings and other structures. It includes equipment to fight fires and equipment to obtain protection from said fires. The building or structure is covered with the shield for protection against fire and is removed when there is no more perceptible danger. The shield for buildings is resistant to fire and is thermo-insulated. It consists of a tractable envelope designed to cover completely and thereby isolate a building from external sources of fire. It can be used to cover almost any building or structure and can be used to protect trucks, cars and other movable objects which are sometimes left behind during flight or evacuation from fire.

The Safety Tunnel Tent. In this comprehensive system, firemen are provided with a novel shelter to be used as practical means to escape from wildfires. This novel protective equipment for firefighters is a fire-resistant, thermo-insulated tent unit that provides shelter and isolation from flames, heat and smoke. It is an independent unit which can be used on its own, independently of other units. It can also be connected to other such units, end-to-end, taking the shape of a tunnel through which firefighters can escape to safety when surrounded by wildfires. Another mode of the tunnel tent is designed for other uses beyond wildfires. Essentially, it is a reinforced version of the tunnel tent designed for heavy duty protection for personnel fighting chemical fires where fires may involve fireballs, burning spilt chemicals on walls and floors and tank and line explosions. This reinforced tent unit can also be used for protecting policemen and the military from bullets and other projectiles, and is discussed in greater detail further ahead.

The Ground Cover Blanket. This same comprehensive system includes the means and tactics with which to fight and control wildfires and to keep prescribed burns under control. It is a ground-cover blanket which has definite applications in the control of prescribed fires and in the tactical fight against wild fires. It is a generally long blanket with a fire-resistant top surface and an abrasion-resistant bottom section. Depending on the materials used, it can incorporate a layer which will resist the flow of air through its layers in order to negate oxygen to the covered ground, making thus fire unsustainable. It is designed to link with other such blankets and to cover the ground for long stretches in order to confine the fire. It can be used in combination with the conventional fire stops made with axe and shovel by firemen. Preferably, it is used alone in a quick series of deployment steps. It is unrolled, linked to other units while being affixed to the ground. When the fire reaches the ground cover, said fire will no longer burn or advance. The ground cover stops the fire when there is no wind. Under windy conditions embers travel far away and may start new fires in new places.

The invention takes other shapes and uses when its embodiments are used in combination to come up with other functions and services. These include the provision of pre-made or standardized fire-resistant covers for dispensing pumps in gas stations. Also contemplated is a diversity of covers for outdoor metal enclosures which house control panels and diverse apparatus used to monitor and provide services to a community. Wooden poles, cars and diverse equipment usually left behind during an evacuation as well as other stationary service equipment can be wrapped with the blanket and protected from fire.

Covering a house with the tractable envelope is a proactive step in its protection. Though many homes are now built with diverse materials which will resist flames, these materials are strategically designed to resist fire originating inside the home. There are kitchen fires, electrical short circuits, and other accidental sources of fire for which there is scant protection. When the source of fire comes from outside, the use of fire-resistant materials used in the building itself is no guarantee against fire. For example, a typical home has open vents in the attic which have been identified as dangerous inlets for fire and embers. Many garage doors don't close tight, providing thus unexpected entry of embers and sparks. Also, it's not unusual to find cracks or air passages through which sparks and embers can penetrate, usually in rooms which do not form part of the conventional living space such as the adjoining garage. Radiant heat passing through a glass window may be strong enough to start a fire inside. Additionally, any broken window will let fire enter. During a fire storm and during windy conditions, flying objects may break a glass window and fire will follow inside. Homes having added structures such as attached patio covers, 'garden closets', and wooden decks, are more likely to burn. In contrast, the envelope will resist not only radiant heat, fire and sparks and embers, it will cover vents, cracks and holes, stopping effectively these potential sources of fire.

The tractable envelope for buildings consists of one or more blankets which can be used alone or assembled together to make a larger unit. Each one of the component blankets is designed to resist fire, radiant heat, sparks and embers, and to reduce the transmission of heat and the passage of air and smoke from top layer through the bottom layer. For convenience, the envelope may be an assembly of smaller blankets, each of which may have any desired shape which will facilitate covering asymmetric structures and still remain accessible to quickly assemble with other such blankets. The most convenient shape is a long rectangle to be packed into a tight roll shape for ease of handling and transportation. Other shapes, such that will aid and simplify covering a structure will naturally include squares, triangles and rounds. In addition, several hoods and caps are used to enclose diverse protrusions which are typically found in homes and other buildings, such as chimneys, vent tubing, antennas and satellite dishes. In gas stations, dispenser pumps are all similar in shape and size and can be covered by standardized hoods. Other covers and caps are also contemplated and are detailed further ahead.

Each said blanket unit consists of several layers of different fabrics and insulating materials. The topmost layer is preferably made of fire-resistant fibers which can be selected from the following: (a) aramid fibers (by DuPont) which are fire resistant, electrically non-conductive and have no melting point below 500 degrees C. (b) M5 Fiber (Magellan Chemical) is an organic fiber, fire resistant and stronger and lighter than aramids; is less brittle than carbon fiber and will yield when stretched. (c) Worbo Inc.'s High Temp Blanket 1000 is manufactured from a continuous filament of texturized E glass yarns; it is flame resistant and fireproof, has high tensile strength, resists oxidation, offers thermal protection, and is rated to 538 degrees C. continuous. It is a very useful product. (d) Carbon fiber fabrics are high strength, light weight but very stiff, which makes handling and storing more difficult but which find use in applications in which tractability is not essential, such as in the tent unit designed as a bellows as described hereinafter. (e) Dectan, a Hartindo product using AF21 can be used for treating fabrics; high heat resistance, non-burning and zero afterglow are properties claimed by manufacturer. It can be useful for treating other component parts of a house envelope and of assorted components of a tunnel tent. (f) Other materials may be selected in response to specific challenges such as when electrical and chemical fires are to be encountered. In this area Pyroblanket™ offers several flame protective fire blankets.

The transmission of heat through the blanket is always an added risk, so it must be lowered in order to provide added security to the house inside the envelope. Heat is one of the components of fire and must lowered at all times, in particular in order to limit the drying-up of flammable material. Fiberflect™ provides for protection against radiant heat which may be used in the top layer. The core layer is made of a thermal-insulating material and is not directly touched by flames. However, under extreme heat conditions, the topmost flame-resistant layer may decay, especially after long exposure, providing the core with a higher dosage of flame and heat. For this reason, a two-ply core construction may be advisable, in which the topmost core layer resists flames or has an aluminum-like foil to reflect radiant heat, and is intimately layered with the lowermost core layer which resists transmission of heat. Passage of air through the core layers is to be prevented to keep smoke from entering the enclosure and to restrict supply of oxygen to the interior. A thin layer of plastic placed between the core layer and the bottom layer is adequate for this purpose. The bottom layer of the blanket is basically a tough, pliable, non-electrical-conductive material meant to withstand abrasion and rough handling.

Each blanket unit is finished all around with suitable cording and incorporates means adapted to ensure an airtight connection with other abutting blankets. One such suitable connection may incorporate zipper means to effect a quick and sure closure and may include overlapping lids to protect the zipper from high temperature and debris. Likewise, other connecting means, such as Velcro can stand alongside with the zipper in order to enable a quick positioning of the blankets, which may be very convenient during emergencies. Availability of hooks and grommets for a direct engagement and/or complementary hooks for an easy interlacing of a rope, engaging a hook on one blanket and then engaging its opposite on the abutting blanket, repeating this operation along the length of the blankets, can be incorporated as well.

Some blanket sections have the added function of providing a downward pull to the envelope or house cover through the incorporation of added weight or of removable ballast. The object is to secure an envelope tightly over the house or structure even under severe windy conditions. Ballast may consist of weights put inside ready-made pouches in the blanket. Weights can also be tied to the envelope wherever they are needed. Additional means to add weight to the envelope is through the incorporation of water jackets in selected blanket units, to be used in combination with regular blankets, in locations where water is plentiful. Blankets incorporating water jackets are preferably positioned in the lower sections of the envelope, that is, close to the ground in order to pull the whole envelope downwards.

When a structure such as a house is to be protected with the envelope, multiple blankets of different shapes and sizes will be assembled on top of the roof and around the walls, entirely covering vents, cracks and windows, in order to provide full cover and thereby isolate the house completely from the outside. Blankets will abut blankets at their respective cords or edges, where airtight closures will be obtained. The covered house will thus become shielded from the external sources of fire and heat. It will remain at a relatively safe temperature in its isolation. When there is no more external fire, no radiant heat, and the threat posed by flying embers has passed, the envelope will be disassembled. The component blanket units will be removed, cleaned and rolled and taken away. The house will be intact, rather clean and ready for continued habitation.

The protection of buildings and infrastructure is the last stand against wildfires that reach human settlements. The envelope provides protection for this stage. However, wildfires are fought and resisted not only in the city/wildland interface, but wherever fire is thought to be dangerous, hazardous or unacceptably destructive of nature, such as highly prized forests of old growth and of giant sequoia trees. Wildfires burn fast and bring frequent surprises which result in deaths and loss of equipment.

The safety tunnel tent of this invention provides support and escape means for firefighters and other personnel. The safety tunnel consists of a multiplicity of tent units designed to assemble end-to-end to form a protected, long, continuous internal passage. Under one form of operation, the first tent is erected at a safe place, and subsequent tent additions are erected in the direction of the fire front to provide a tunnel with an entrance at the fire front where firemen may turn to, to escape an encircling fire. It can also be used as a safe area to provide rest and medical aid for firemen. Individual tent units can be used independently of other tent units to provide a safe haven for firefighters in isolated areas in the wild. A tunnel tent may also connect two camps together. These tent units can be air-dropped to spots in the mountain during the fire emergency or positioned in advance of subsequent tactical deployments of personnel and equipment.

The tent unit is made out of one or more blankets, each built to resist external fire and to stop the passage of heat to the inside of the tent. Different fire-resistance specifications will apply as the use of the tent unit becomes specialized for specific applications. It is fire-resistant up to 500 deg C. and can withstand higher temperatures during short intervals. Contains enough thermal insulation to keep the inside temperature below 120 deg C. All doors, windows and vents can be closed airtight. It preferably includes a floor section since uneven ground floor in the forest can diminish or compromise the isolation of the interior from extremely hazardous external conditions. The top portion of the tent unit is a tractable, fire-resistant, thermo-insulated blanket. The floor section is made of a tractable material meant to withstand abrasion from below, or outside, such as rocks and shrub; it is resistant to heavy traffic from above, inside, and can resist secondary wear and tear such as dragging of axes and shovels. The floor section of the tent can be removed partially or completely from the inside, allowing a person or two to move the tent from its place just by walking and pushing said tent. This is an important convenience since external conditions may change and an emergency relocation might become desirable. In the particular mode of safety tent for police and military use, the ability to relocate the tent at will from the inside will provide added security and tactical advantages to the tent users. It has a door at each end, made of the same material as the top, with which an airtight closure can be obtained. Some units may incorporate more than two doors where junction with a third tent unit is desirable such as a medical station or a covered room for supplies or rest area. It has at least one window furnished with mosquito net to provide ventilation and some resistance to the flow of ash; it has a removable, fire-resistant, see-through shell with which the window is closed to provide lighting from outside without air passage when it is desirable to initiate isolation from external conditions; said window is also furnished with a blind to stop radiant heat if necessary. The unit is provided with additional vents, some located close to the ground which can be used to enhance air circulation or, under different conditions, to draw air in when smoke is hanging above but has not reached ground level. Vents may be furnished with the same components as the windows. The object of having the combination of windows and low lying vents is to obtain ventilation and air circulation when possible, and natural lighting when available.

All or most tent units incorporate an emergency entry and exit to allow entry or escape at any point of the tunnel extension. This entry/exit means may be limited to a side slit in the tent provided with zipper means operable from inside and outside. An "L" shaped slit allows a firefighter to slide in, close to the ground, where flames may be less intense. The vertical or near vertical portion of the "L" slit provides for a more conventional, that is 'upright', passage to and fro when possible or needed.

Distinctive colors help the tunnel tent to stand out amid smoke and flames and in the darkness or in the glow of smoldering fires. Firemen can see the tunnel if all other directions and high tech gear are lost in the fight or fail to work when needed. Luminiscent paint reflects light and continues to shine alone in the dark for a limited time, which makes it ideal for painting tent outlines and distinctive marks and instructions at all access-egress openings. Simple and clear signals tell the user where to enter, how to zip open the access, how to close. Inside, all necessary instructions remind the firefighter how to perform survival tasks, where to look for communication gear, first aid kits, oxygen tanks, water and biscuits. Once inside the tent, an important decision is whether to stay and rest or to walk back to the tunnel entry and escape alive and possibly unharmed. Wind, heat and smoke conditions will tell the firefighter to open or close doors between tent units. Closed doors keep smoke from entering the tunnel where each unit, if closed at both ends, is a compartment holding air and supplies. If the units near the fire front are crowded with firemen recovering from the fight, open or closed windows and vents will provide much needed air when conditions permit. Calling and monitoring other firemen still active in the fire front will be possible from this safe place.

In a first mode, the overall shape of the unit before pitching is that of a hose or of a long flexible tube. It is extended and flattened on a flat surface and then rolled into a tight bundle for storage and for transportation. The shape of the pitched tent is the shape of the metallic framework which supports it.

The size of the tent is conjectural. Where the tent will be used as an isolated unit and last ditch refuge, internal mobility is not of the utmost importance. It need only be big enough to shelter one or more firemen and supplies. Where the tent will be linked to other tents in order to form the escape tunnel, mobility inside is of great importance since firefighters will be going from the fire front all the way to the entrance of the tunnel and may be hauling medicine and supplies back and forth. In this light, a tunnel tent must be tall enough to allow at least one fireman to walk, with or without helmet, from one end to another. A preferred embodiment is a compact tent unit shaped like a trapezoid, about 6'2" interior height, 20" across at the top and about 40" across below, and about 30' long. These general dimensions reflect the desirability of obtaining compact units that will be easier to store, transport, deploy and pitch. Where other conditions prevail, bigger or smaller tent units may be selected. Other sizes and shapes and combinations thereof are contemplated as well, all of which fall within the scope of this invention.

The framework of the tent unit can be internal or external. The basic framework consists of two or more frames, preferably trapezoidal in shape, linked by long crossbars forming a structure onto which the tent unit may be mounted and affixed. Tent units longer than 30' may include one or more additional frames in between to provide support and shape. While there is no limitation in the length and/or overall size of the unit, it should be limited to the bulk and weight which one or two firemen can lift and carry and move about. Heavier units can only be deployed with specialized equipment which limits usefulness and availability in places where there are no roads and where there are other similar transportation limitations and problems.

In a first mode, the frame is a trapezoid that can be folded for storage and transportation. The horizontal top bar of the frame is connected to the vertical bars by means of pivots; the bottom bar is pivotally connected to one of the vertical bars and latches on to the second one of the vertical bars. The frame features adequate connective means to secure a firm connection with the crossbars. It has means to connect and fasten to a proximate frame of an adjacent tent unit when a tunnel tent is being constructed. Said frame also features adequate means to strap or otherwise fasten the tractable tent unit thereto. The horizontal bottom bar has foldable extensions that pivot outwardly as support feet when the frame is installed for use. The crossbars can be folded for storage and transportation.

The trapezoid frame, as an alternative, may consist of a single, solid piece featuring the same means for connecting with crossbars, with adjacent frames and for fastening the tractable tent unit thereto. It is especially useful in connection with the tent having a bellows configuration, as described hereinbelow, since said tent unit retains its shape even when compacted to its minimum bulk.

A second mode for the tent unit incorporates the use of fire-resistant, thermo-insulated materials or blankets similar to the ones used in the first mode. In this mode, the alternative or additional use of rigid and stiff components is practical and useful. Instead of a hose or tube construction, the general configuration is of a series of pleats or folds similar to a bellows. In a closed position, pleats stand parallel to, and press against, each other. In the open position, pleats unfold and extend from one another in order to form a longer unit. This configuration incorporates two rigid frames, one at each end, connected by crossbars. The rigid frames give shape and structural support to the respective entrances of the tent unit. The crossbars attach to the frames and provide the lengthwise structural component of the tent unit. Pleats retain their generally rectangular shape, whether the tent unit is folded or extended. With the availability of these rigid pleats, it is possible to use other materials which resist fire but are less tractable. For example, carbon fiber fabrics are lightweight and high strength but stiff. Carbon fiber fabrics may be combined with other engineered composites to achieve fire resistance and thermal insulation in the creation of a protective tent unit.

This second mode is ideally suited for an industrial environment where chemical fires involve high temperatures and hazardous gases and fumes. It is noted that in an industrial stage, storage of flammable liquids and gases usually involves contents under pressure and great volumes. Also, an ample variety of other hazardous chemical products such as paints, resins and plastics end up as part of the conflagration. Firefighters need a safety tunnel tent that will withstand metal fragments coming from exploding tanks and lines and from all manner of falling debris. The tent framework is reinforced according to expected conditions of use and the top and core layers are toughened to resist impact and to provide and added inertia to stop impacting bodies. This design can be customized as a bullet and projectile resistant tunnel tent. It is a new and useful tool providing instant fortification for police departments and the military. It is easy to transport and to deploy in different scenarios using only conventional transportation means. It can quickly be made operational by personnel operating from inside the tent unit to reduce exposure to external conditions. Selected areas may incorporate shielded ports for firing guns from inside as well as for installing monitoring equipment and other devices. It is erected by stretching the unit, and is linked to other units while limiting or eliminating exposure to enemy fire. One or more such units can provide provisional safety quarters and serve as headquarters for police or military personnel during an emergency. Outlaws or terrorists entrenched in a building, car or open area can be surrounded with a safety tunnel tent and subdued under favorable conditions for police or military agents. The projectile resistant tent enables forward placement of emergency medical operations and will be used to house and to evacuate personnel. It incorporates natural and artificial light sources, natural air inlets with appropriate screening of filtering and side doors for discretionary use.

A novel bellows construction is additionally disclosed herein and projected as an alternative to the conventional bellows. It can both compress more, resulting in a reduced bulk, and extend more, for added cover, than a conventional bellows. This characteristic is ideally suited for the optimal use of storage space. Also, it can be transported more efficiently since more units can fit inside the cargo space of a truck, while each unit provides additional square feet of covered protection.

A conventional bellows can be folded and extended. When folded, the thickness of the bellows equals the thickness of all the folds or pleats which make up the bellows; when extended, the added width of all the pleats equals the total length of the bellows.

In contrast, the novel bellows provides for a two-level (or more) pleat distribution for the folding position. This is attained by the use of tactically distributed long pleats which connect two levels of folded short or single-length pleats, as follows: there is a first series of short pleats folded together at the end of which a long pleat reaches all the way to a second level where it becomes the first pleat of a second series of short pleats which fold and press against one another; the last pleat of this second level is a long pleat which extends back to the first level, initiating a third series of pleats alongside the first said series, and so on, for the length of the bellows. When the entire bellows is folded and compressed, the second level of folded pleats is housed just underneath the first level of pleats; the bellows thus compresses to the combined thicknesses of the pleats in the first level, while the pleats in the second level are out of the way and do not add bulk. When the bellows is in its extended position, the added widths of both first and second level pleats plus the length of the long pleats make up the total length of the bellows. This novel bellows can be made with a combination of more than the two levels of pleats described hereinabove, in order to obtain an additional degree of compactness and/or additional extended length of the tent unit. The combination of short and long pleats can take different shapes such as having one long pleat next to a short pleat, followed again by a long one. This provides the same advantages of lesser bulk when compacted and longer coverage when extended.

IN THE DRAWINGS

Figure 6A:
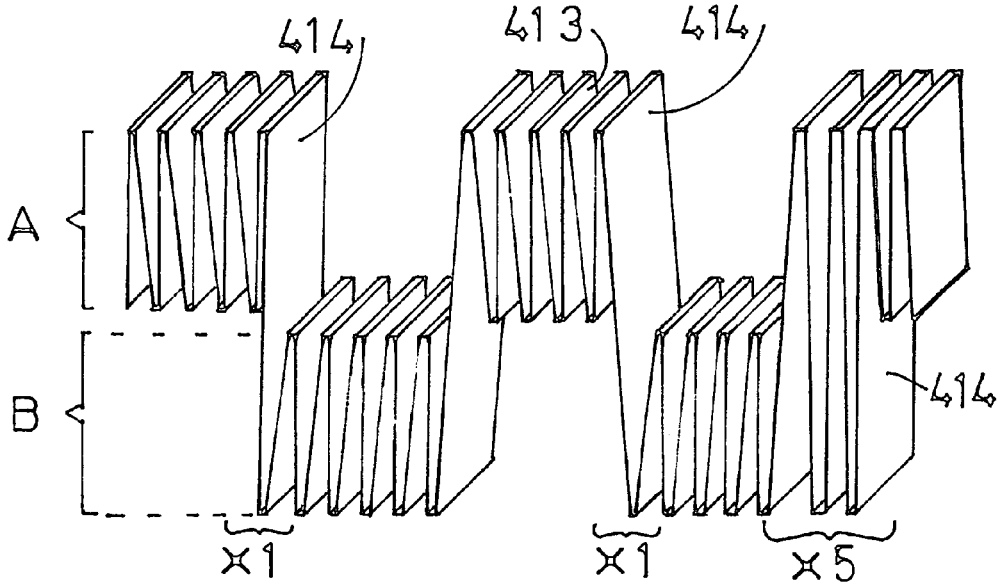
Figure 6B:
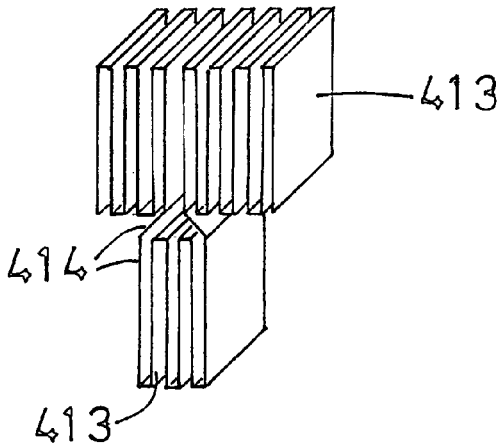
Figure 7:
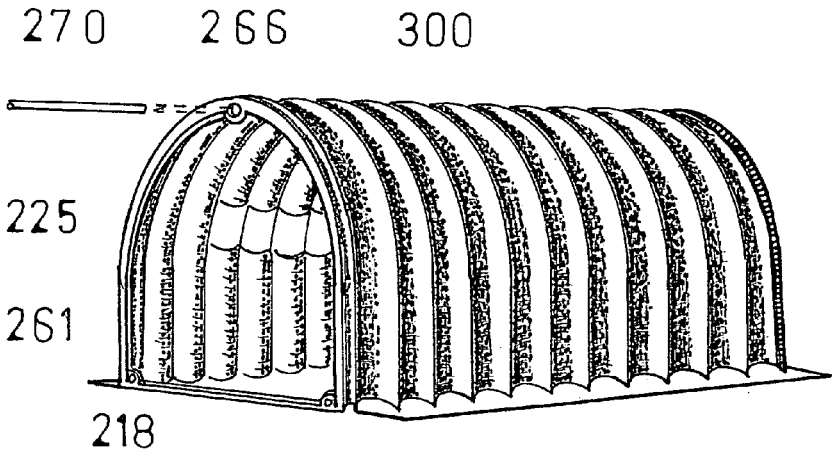
Figure 8:
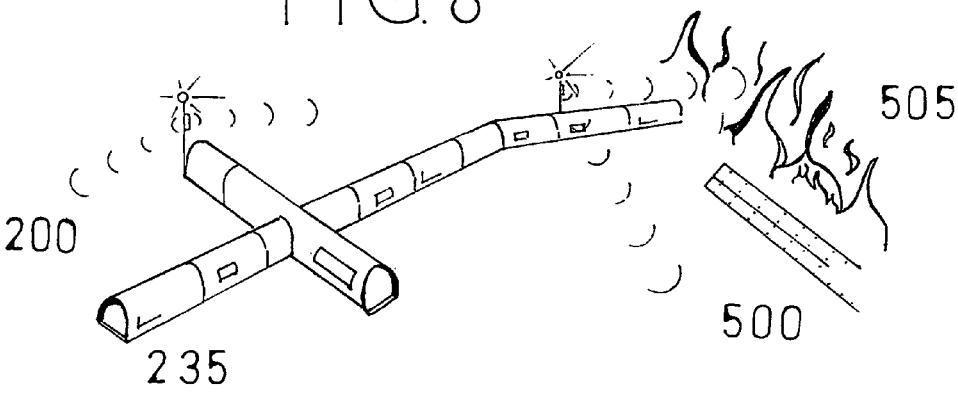
Figure 9:
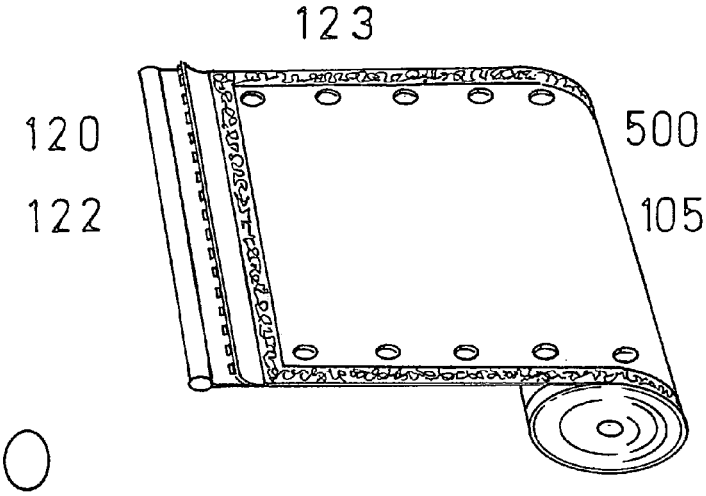
Figure 10:
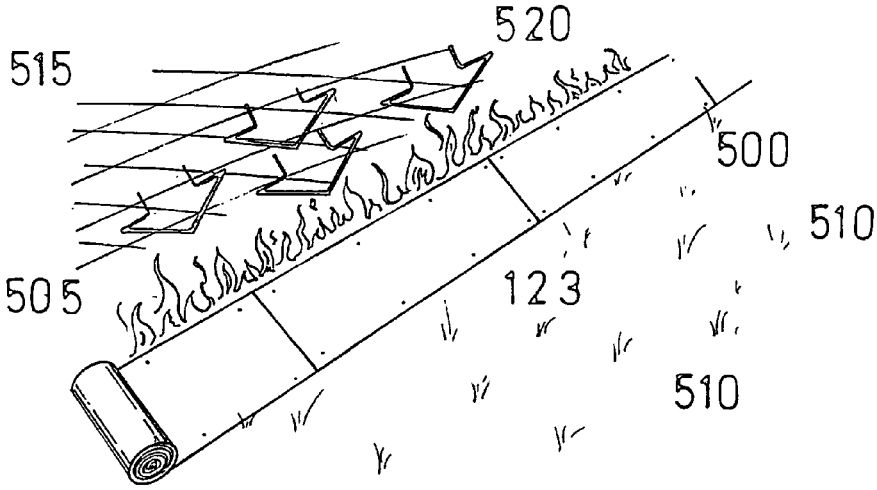

FIG. 6*a* is a schematic representation of novel bellows folding configuration FIG. 6*b* is another schematic representation of novel bellows configuration FIG. 7 is a perspective view of a bellows construction tent unit FIG. 8 is a perspective view of a tunnel tent reaching inside a wildfire front FIG. 9 is a schematic view of a ground-cover blanket FIG. 10 is a perspective view of idealized use of ground cover in a field of fire

DETAILED DESCRIPTION OF THE INVENTION

Figure 1:
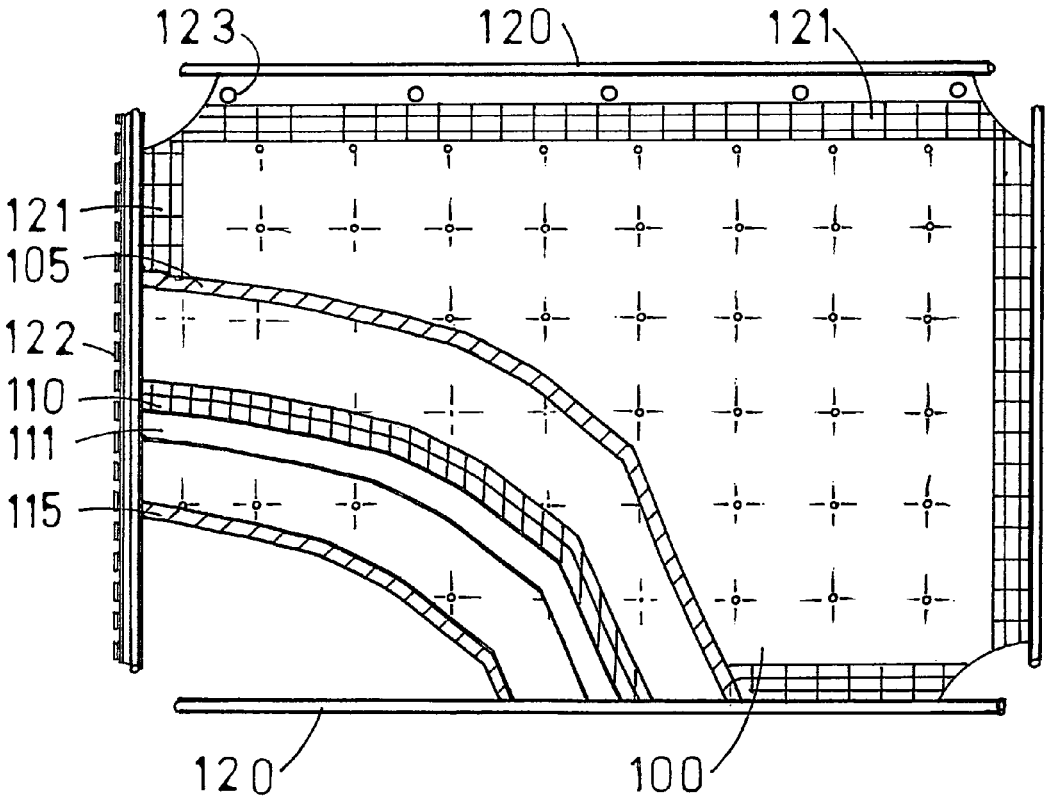
FIG. 1 is a schematic representation of the tractable, thermo-insulated blanket.

FIG. 1 shows a tractable, thermo-insulated blanket 100 having at least a top layer 105 made of fire-resistant materials; a middle or core section 110 made of thermally insulating materials in one or more plies; a bottom layer 115 made of abrasion-resistant materials. A thin thermoplastic layer 111 can be positioned between the core section 110 and the bottom layer 115 to stop all passage of air or smoke therethrough. Blanket 100 is finished all around with suitable cording 120, having alone or in combination, connective means such as Velcro track 121, zipper means 122 and multiple grommets 123 for linking with other similar units.

Blanket 100 can be made of different materials and in diverse combinations of fire resistant fibers in anticipation to specific applications. In order to increase grades of fire resistance, top layer 105 can be made of pyroblanket 17 oz which has the following desirable characteristics:

| | |
|---|---|
| Maximum short term exposure to heat: | 2160 degrees F. |
| Continuous operating temperature | 500 degrees F. |
| Flame resistance | very good |
| Abrasion resistance | very good |
| Flexibility | outstanding |
| Water and oil resistance | outstanding |

Cellulous fiber has excellent heat-insulation properties and can satisfy the required criteria for use as core 110, in combination with top layer 105 which will resist flames directly. When used in an industrial setting with electrical wiring as a potential hazard, non-conductive fibers should be used. A commercial product such as Technora™ is non-conductive, with no melting point below 500 degrees F. and does not ignite in normal levels of oxygen.

Nomex and Kevlar by DuPont are both fire-resistant and thermally insulating; the two are used in combination to make turn out gear for firemen. Nomex provides thermal protection for a limited time. Nomex chars after a few seconds of exposure to flame, which forms a barrier to flames since it extinguishes the source or fuel for the flame. This combination of two fibers, alone or reinforced with added layers of Nomex, can be used for top layer 105. Core section layers 110 may include a thin layer of thermoplastic lining to prevent the passage of air beyond the top-core layers in order to starve fire from oxygen inside the enclosure. Bottom layer 115 can be made of highly resistant fibers such as Kevlar, or just reinforced with Kevlar in sections where a high degree of abrasion is expected. Otherwise, canvas and/or denim are suitable for the bottom layer. These can be additionally coated or treated with chemicals such as Hartindo AF21 which will enhance safety and which will protect against flames in the unlikely breakthrough of fire through upper layers 105 and 110.

Slide 140 is a device for connecting two blankets together. It has a C-shaped profile at each of its two opposing ends, designed to slidably enclose and loosely grip the cording of two proximate blankets. The adjoining cords of two blankets are simultaneously introduced into both c-shapes of a slide in order to hold them together. The slide, whether short or long, covers the gap between blankets against fire, embers, sparks and smoke, effectively sealing the gap between two blankets.

A runner slide connects two blankets together along their entire length. Like slide 140, its cross-section is of two, opposite C-shapes which engage and loosely grip the cording of the two opposite blankets. The runner slide is a long blanket having a top fire-resistant layer, a heat insulating core and an abrasion-resistant bottom layer. At each side it has C-shaped inserts which are meant to slidably enclose and loosely grip the cording of two proximate blankets. Runner slide 142, covers the gap between two blankets, effectively keeping flames, heat, ashes and smoke outside the envelope. Slides 140 and runner slides can be used in combination or independently of each other.

Runner blanket is narrow and long, spans both blankets 100 and engages its own two Velcro tracks with the two corresponding Velcro tracks on the blankets. This cover may be used together with, or independently of slide 140 or the zipper means 122. It protects against penetration of flames, smoke and heat along the entire length of two proximate blankets.

Envelope 130 covers a structure such as house 131 entirely. It makes a complete separation between external ambient temperature and internal temperature and conditions. It keeps flames, radiant heat, embers, smoke and fire debris outside.

Figure 2:
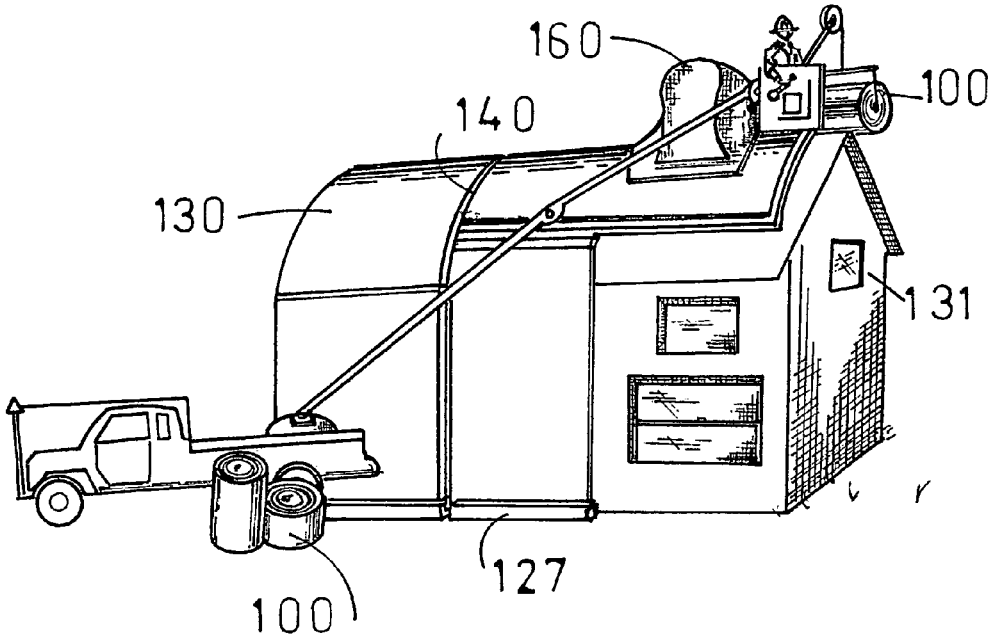
FIG. 2 is a perspective view of an enclosure being erected

Envelope 130 consists of one or more blankets 100 joined together by the combination of one or more slide 140, runner slide and runner blanket 125 as shown in FIG. 9, zipper means 122 and Velcro track 121. The combination of one or more ballast means such as weight 127 and/or a water jacket is used to pull down the envelope tight against the ground, effectively stopping air flow into or out from envelope 130. The house or structure thus secluded will not burn.

Where structures tend to be of a similar shape and size, pre-made or standardized covers are incorporated. Thus, cover 160 of FIG. 2 can be used for all standard chimneys. Standard cover designs for gasoline pump dispensers in gasoline stations or instrument boxes along sidewalks provide easy protection. Automobiles, gas tanks used in outdoor kitchens and other equipment and structures are contemplated as well.

Figure 3:
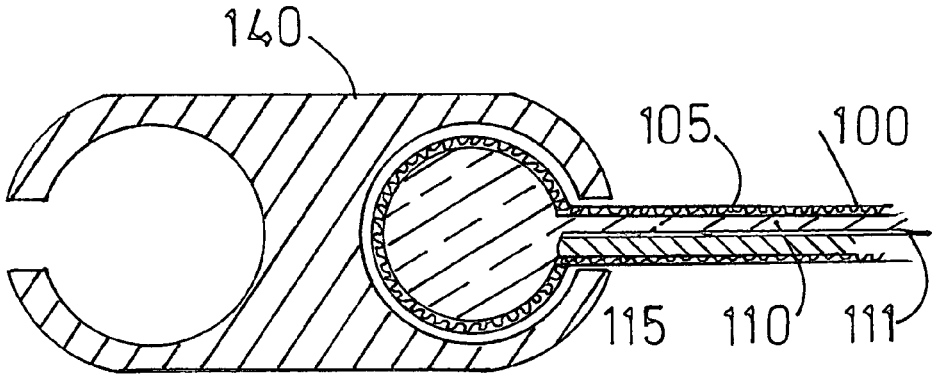
FIG. 3 is a cutaway view of a slide gripping blanket cording
Figure 5:
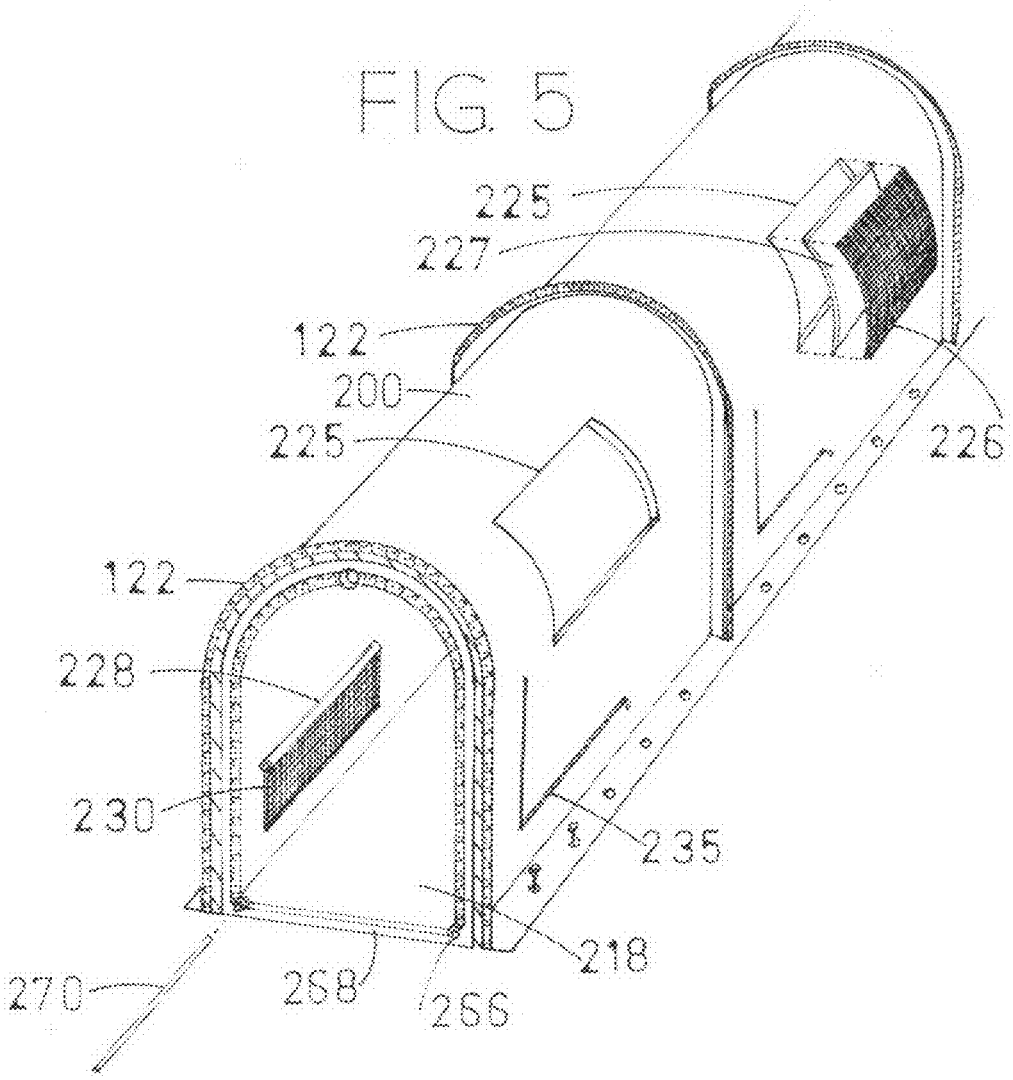
FIG. 5 is a perspective view of the tunnel tent

Tunnel tent unit 200 as illustrated in FIG. 5 begins with tent unit 200 where the enclosure is made using blanket 100 (shown in FIG. 1) and floor 228 preferably made of an abrasion-resistant material such as Kevlar to resist heavy traffic and mistreatment such as dragging of shovels and other tools during emergencies.

Where other conditions prevail, the floor section can be made of canvas, denim or similar materials. Said floor section can be reinforced with a thin core-section of thermoplastic material to prevent passage of smoke and other gases into the enclosure and to keep breathable air inside said tent. The floor section can be removed partially or completely from the inside. A partial removal can be undertaken with the object of changing location of tent by pushing it without necessity of exiting. Floor removal is an additional emergency exit option. The basic tent unit has one door at each end that can be closed with a two-sided zipper; said door can be opened vertically for walking entry and egress or can be opened sideways to allow passage to and from tent at ground level, allowing the user to slide from one tent unit into another while limiting entry of smoke from one unit into another. Said basic tent unit has one or more window 225 consisting of mesh 226, transparent shell 227 and blind 228 and has one or more vent 230 located close to the ground to avoid smoke and flames, and door 235. Tent units are joined together using zipper means 122 or a runner slide with Velcro track 121, or slide 140, shown in FIG. 3, with cording 120.

Figure 4:
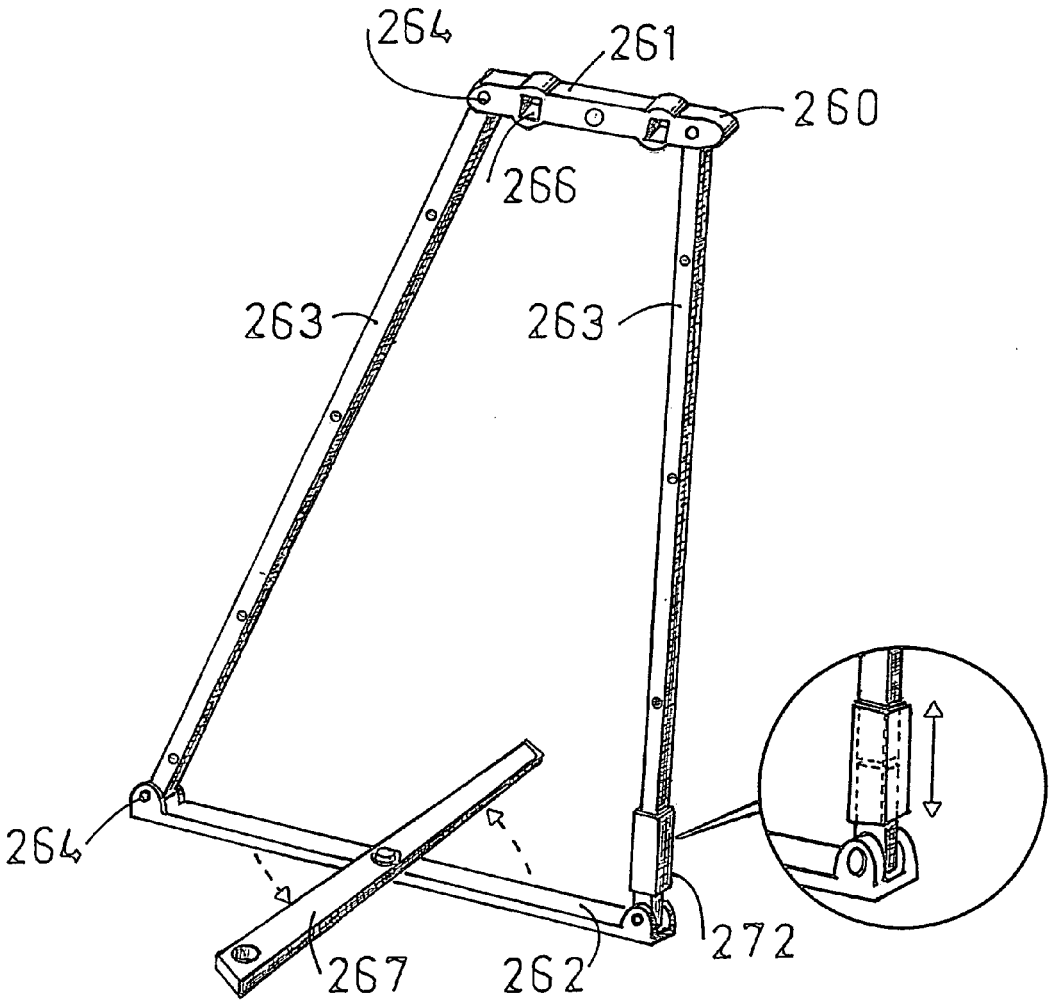
FIG. 4 is a perspective view of tunnel tent trapezoid door frame

Door frame 260 of FIG. 4 is depicted as a trapezoid, which is the preferred shape when said frame is made to be collapsible since component bars can pivot and fold to minimal bulk. If door frame is a one-piece structure, such as frame 268 shown in FIG. 5, other tent profiles can be selected as more desirable such as a curbed ceiling since it provides more head room. Door frames connect with crossbars 270 to make a long tent-unit structure. Door frame 260 has top bar 261, bottom bar 262, uprights 263, pivots 264, latch 265, holes 266, and stabilizer foot 267. Crossbars 270 insert in holes 266 where sliding tube 272 secures crossbars in place. Crossbar 270 may be a single-piece of a given length or several pieces of a collapsible structure which pivots open and is held secure in that position. Crossbars may also consist of several tubular lengths telescopically engaged to one another and which extend to provide greater length when in use. Other combinations are possible and envisaged within the scope of this invention.

Tunnel tent unit 300 of FIG. 7 is of a construction similar to a bellows where pleats or folds extend lengthwise in the open position and stand parallel to each other in the closed position.

Pleats can be rigid and may incorporate an outer skin of bullet resistant fabric such as Kevlar, followed by a flame resistant layer. Other layers may incorporate protective elements selected in accordance with the expected use of the tent.

Novel bellows of FIGS. 6*a* and 6*b* can be compressed to about the bulk of one half of its folded pleats. This is achieved by folding pleats in two levels: A and B. The bellows will compact to the size of the first level A of pleats 413. Second level B of pleats 414 will be stored below said first level A. Since there are two levels, A and B, a compacted bellows will be as thick as level A while all pleats of level B will store underneath and will not add bulk to the compressed bellows. This is best done by alternating levels A and B so that a series of pleats in level A is followed by a series of pleats in level B which in turn is followed by a series in level A, and so on for the length of the bellows. One series of pleats in one level connects to the next series in another level by the use of long pleats located at the end of each series. When the bellows is extended, the length of said bellows will be equal to the combined lengths of all pleats, those of level A and those of level B.

This novel bellows construction can be made of more than just the two levels described above. Also, other combinations are possible such as having more than one long pleat connecting two levels. This is illustrated in FIG. 6*a* where the number of long pleats is identified with notations "x1" (times 1) for one long pleat, "x3" (times 3) for three long pleats. Other combinations, not illustrated, such as "x2" or "x4" or "x5" or another, are possible. Again, the combination of more pleats in one level and less pleats in the next level is within the scope of this invention. Long pleats can be used to incorporate windows for light and air or for ports where monitoring devices can be placed.

Fire stop ground cover 500 as illustrated in FIGS. 8, 9 and 10 is a long piece of material resembling blanket 100. It is designed to cover ground to stop grass and brush fires 505. It has a fire resistant top layer 105, abrasion resistant bottom layer 115, as shown in FIG. 1. Core layer 111, shown in FIG. 1 stops flow of air to negate oxygen to underlying fuel and has plentiful grommets 123 where spikes will go through and bury into the ground to keep the fire stop 500 in place. Fire stop covers can join other similar units with the single or combined use of cording 120 and slide 140 or runner slide 142 or runner blanket 125. A fire spreading along grass and brush 510, in the general direction indicated by arrows 520 and leaving behind burnt material 515, will not burn the firestop, nor the fuel underneath the firestop, effectively stopping the fire. Firestop 500 can be used to demarcate areas for prescribed burns and for other tactical uses during a fight against the spread of fire. Firestop 500 is highly adaptable and can also be wrapped around trees and poles in conformance to different environments and as novel fire-fighting tactics are developed. During yet another unforeseen circumstance, a firefighter may find some protection from the fire, embers and smoke by sliding underneath a ground cover.

The invention claimed is:

1. A system of multi-layered, tractable, fire-resistant and thermally insulated blankets for shielding and protecting diverse structures, objects and people from fire, comprising:

a plurality of connectable blankets, each said blanket comprising:

a flexible top layer being made from one of either fire-resistant aramid fibers or organic fibers treated to withstand damage from fire;

a flexible core layer having thermo-insulation properties disposed directly beneath said flexible top layer, said flexible core layer being made from one or more plies of cellulous fiber material;

a thin layer of flexible thermoplastic material disposed directly beneath said flexible core layer which prevents passage of air and smoke therethrough;

a pliable, non-electrically conductive bottom layer having physical properties for withstanding abrasion and rough handling disposed directly beneath said thin layer of flexible thermoplastic material, said bottom layer being made from one of either aramid fibers or denim material;

a continuous cord disposed on and defining an entire periphery of said blanket;

a series of grommets disposed on at least one peripheral edge portion of said blanket proximate at least a portion of said continuous cord;

a zipper element disposed on at least one peripheral edge portion of said blanket proximate at least a portion of said continuous cord; and a hook-and-loop fastener material track disposed around said entire periphery of said blanket proximate said continuous cord;

the system further comprising: at least one fire-resistant and thermally insulated cord-gripping slide device, said at least one slide device having two opposing rigid C-shaped ends, wherein each said C-shaped end is configured to engage a portion of said continuous cord of one of said blankets along a corresponding peripheral edge thereof, whereby at least two of said plurality of blankets can be connected together in an abutting configuration, and whereby a gap between abutting blankets is covered by said slide device, such that fire, embers, sparks and smoke are sealed from passing through said gap.

2. The system according to claim 1, further comprising:

at least one ballast element connected to at least one of said plurality of blankets, wherein said plurality of blankets are configured to be connected together so as to form a single, contiguous tractable envelope which is capable of completely covering a structure, and wherein said at least one ballast element is configured to be pulled down tightly against a ground surface adjacent said structure, whereby said structure is completely separated and protected from fire, heat, embers and smoke located outside of said structure.

3. The system according to claim 1, further comprising:

a plurality of door frame assemblies, wherein said plurality of blankets are configured to be connected together in an end-to-end configuration so as to form a plurality of tunnel-tent units, wherein one of said door frame assemblies is located at each end of each one of said tunnel-tent units, and wherein each said door frame assembly is adapted to connect to an adjacent door frame assembly of an adjacent tunnel-tent unit, whereby a series of connected tunnel-tent units can be assembled to form an elongated, continuous internal passage to protect and harbor persons and provide a protective exit path for evacuation from an externally located fire.

4. The system according to claim 3, wherein said plurality of blankets which form said plurality of tunnel-tent units are constructed so as to have a bellows configuration formed from a series of connected long and short folded pleats which are capable of expanding and contracting, said short pleats being configured to fold and group at upper and lower levels, said upper and said lower levels being connected to each other by at least one of said long pleats which fold and stack with both said upper and said lower levels of said short pleats while connecting both said levels, thereby reducing bulk when contracted and thereby extending to a total combined length provided by said long pleats and said short pleats of both said upper and said lower levels.

5. The system according to claim 1, wherein said plurality of blankets are configured to be connected to one another so as to form a fire stop ground cover, which prevents spreading of a fire along outdoor ground surfaces having grass and brush, and wherein said grommets are configured to have spikes pass therethrough and into the ground so as to fix the fire stop ground cover in a desired location.

* * * * *